US005396677A

United States Patent [19]

Rissik et al.

[11] Patent Number: 5,396,677

[45] Date of Patent: Mar. 14, 1995

[54] UNDERWATER CLEANING DEVICE

[76] Inventors: George V. Rissik, 66 Goethe Road, Lombardy East, Transvaal Province, South Africa; Wilbraham C. K. Vickers, 21 Lucas Road, Eastleigh, Edenvale, Transvaal Province, South Africa

[21] Appl. No.: 143,428

[22] Filed: Oct. 25, 1993

[30] Foreign Application Priority Data

Aug. 26, 1993 [ZA] South Africa ..... 93/6257

[51] Int. Cl.[6] ..... E04H 3/20

[52] U.S. Cl. ..... 15/1.7; 15/246

[58] Field of Search ..... 15/1.7, 257.01, 246

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |
| 4,351,077 | 9/1982 | Hofmann | 15/1.7 |
| 4,463,468 | 8/1984 | Chauvier | 15/1.7 |
| 4,530,125 | 7/1985 | Hofmann | 15/1.7 |
| 4,920,599 | 5/1990 | Rief | 15/1.7 |
| 5,014,382 | 5/1991 | Kallenbach | 15/1.7 |
| 5,077,853 | 1/1992 | Campbell | 15/1.7 |
| 5,106,492 | 4/1992 | Distinti | 15/1.7 |

FOREIGN PATENT DOCUMENTS

| | | | |
|---|---|---|---|
| 2153209 | 8/1985 | United Kingdom | 15/1.7 |

*Primary Examiner*—Edward L. Roberts

*Attorney, Agent, or Firm*—Marshall, O'Toole, Gerstein, Murray & Borun

[57] ABSTRACT

A device for use in cleaning underwater surfaces has a body with an inlet and an outlet for connection to a flexible suction hose; a flexible foot member adapted to at least partially surround the inlet; means for interrupting the flow between the inlet and the outlet and guide means projecting from the body in the direction of movement thereof. The guide means preferably comprising an arm adapted to extend from the body and terminating in a rotatable wheel lying transversely to the axis of the inlet of the body.

6 Claims, 1 Drawing Sheet

UNDERWATER CLEANING DEVICE

INTRODUCTION TO THE INVENTION

This invention relates to a device for cleaning underwater surfaces such as are found in swimming pools and the like.

BACKGROUND TO THE INVENTION

One common type of device includes a planar member of flexible material which is adapted to move across the surface to be cleaned. The flexible member surrounds a suction orifice which is connected via a mechanism to move the device and a flexible hose to the inlet of a filter system for the pool. These features are well known and will not be described in any greater detail.

As the device moves across a surface it may become lodged in a corner or against a step for example and be unable to move. Unless the device is guided out of such situations it will remain in that position and not be able to fulfil its designed function.

An object of this invention is to provide a device of the type described including means for guiding the device.

SUMMARY OF THE INVENTION

According to the invention a device for use in cleaning underwater surfaces comprises:

- a body having an inlet and an outlet adapted for connection to a flexible suction hose;
- a flexible planar foot member adapted to at least partially surround the inlet;
- means for repeatedly interrupting a flow of liquid between the inlet and the outlet; and
- guide means projecting from the body in the direction of movement thereof.

Further, according to the invention, the guide means is removably attached to the body.

Still further, according to the invention, the guide means comprises an arm adapted to extend from the body and terminating in a rotatable wheel lying transversely to the axis of the inlet to the body.

Still further, according to the invention, the wheel is loosely mounted to the arm by means of a short axle projecting, in use, towards a surface to be cleaned.

Still further, according to the invention, the axle is movable in a mounting and this movement includes movement in an axial direction.

Still further, according to the invention, the guide means may incorporate cleaning means and the cleaning means comprises at least one brush attached in the guide wheel.

BRIEF DESCRIPTION OF THE DRAWINGS

An embodiment of the invention, described by way of example only, follows with reference to the accompanying drawings in which.

DETAILED DESCRIPTION OF THE DRAWINGS

Figure 1:
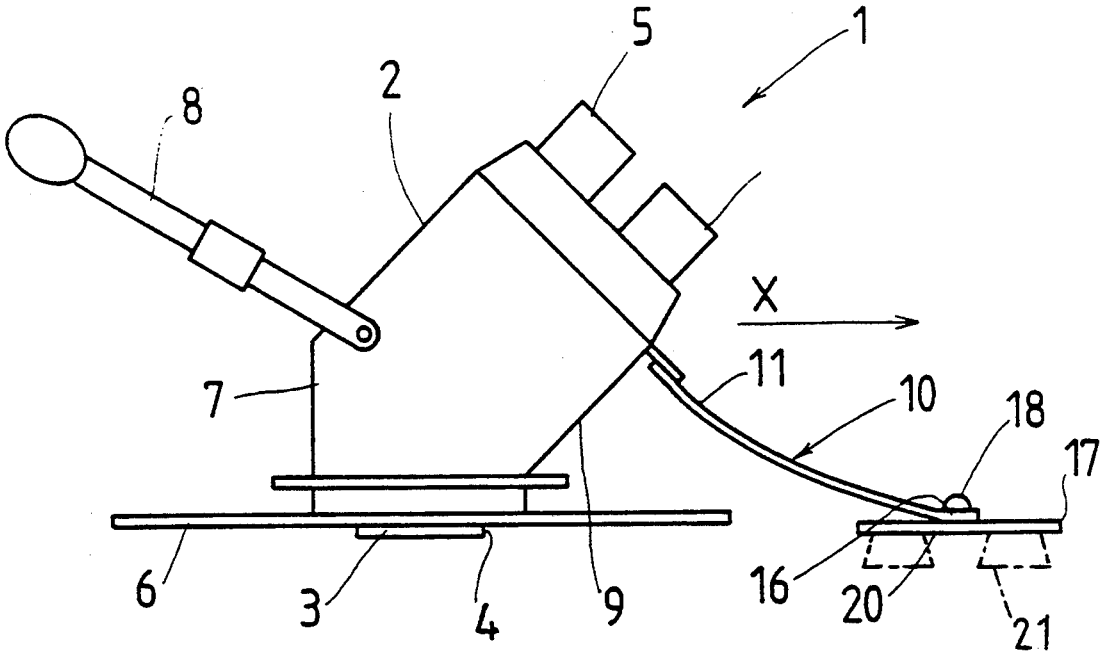
FIG. 1 is a side elevation of a pool cleaner.
Figure 2:
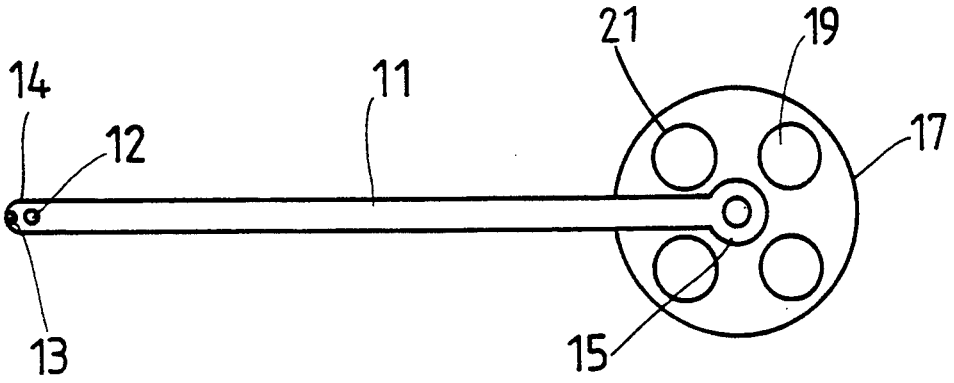
FIG. 2 is a plan of the guide means for the cleaner.

In this embodiment of the invention a device (1) for use in cleaning the submerged surfaces of swimming pools is provided.

The device (1) comprises a body (2) having an inlet (3) at the bottom (4) thereof and two outlets (5) at the top of the body and having their axes at an acute angle to the bottom of the body. The outlets (5) are adapted to be connected via elongated passages to a flexible suction hose and hence to the filtration system of a swimming pool.

Surrounding the inlet (3) is a flexible foot member (6) which is adapted to be located against the submerged surface to be cleaned.

At the rear (7) of the body is a hinged float member (8).

All of the above aspects of the device are well known in the art of pool cleaning devices.

The device (1), in use, moves in the direction indicated by arrow "X" in the drawing. Fixed to the forward side (9) of the body is a guide means (10) which projects forwardly and downwardly in direction "X".

The guide means (10) comprises an elongated arm (11) having an aperture (12) and a locating formation (13) in one end (14). The arm is adapted to be fixed to a formation on the body by means of a pin or nut and bolt extending through the aperture (12). The locating formation (13) engages with a cooperating formation on the body to prevent pivoting of the arm about the pin or bolt through aperture (12).

The other end (15) of the arm is enlarged and includes a central mounting aperture to loosely accommodate the short axle (16) of a rotatable guide wheel (17). The axle (16) includes a flanged top (18) to prevent removal of the axle from the aperture.

Because of the loose fit the guide wheel (17) can not only rotate about its axis but can move in an axial direction and also swivel about its axis.

The guide wheel (17) includes four circular apertures (19) therein. These apertures may be used as mounting apertures for short brushes 21 which extend downwardly from the bottom surface (20) of the wheel and which perform a cleaning function in use.

It is envisaged that the guide means will serve to assist in moving the device (1) out of difficult positions such as corners and steps where other devices of a similar nature usually become stuck.

Other embodiments are envisaged within scope of the invention including other configurations thereof.

What I claim as new and desire to secure by Letters Patent is:

1. A device for use in cleaning underwater surfaces wherein the device includes a body having an inlet and an outlet adapted for connection to a flexible suction hose, a flexible planar member adapted to at least partially surround the inlet, means for repeatedly interrupting a flow of liquid between the inlet and the outlet, and guide means projecting from the body in the direction of movement thereof, wherein said guide means comprises an arm adapted to extend from the body and terminating in a rotatable wheel lying transversely to the axis of the inlet to the body.

2. A device as claimed in claim 1 in which the wheel is loosely mounted to the arm by means of a short axle projecting, in use, towards a surface to be cleaned.

3. A device as claimed in claim 2 in which the axle is movable in a mounting and this movement includes movement in an axial direction.

4. A device as claimed in claim 1 in which the guide means incorporates cleaning means.

5. A device as claimed in claim 4 in which the cleaning means comprises at least one brush.

6. A device as claimed in claim 1 in which said guide means is removably attached to said body.

* * * * *